United States Patent [19]

Bringhurst

[11] Patent Number: 4,591,280

[45] Date of Patent: May 27, 1986

[54] PERMANENT MAGNET, STORED ENERGY, PRINT HEAD

[75] Inventor: Edward D. Bringhurst, Seattle, Wash.

[73] Assignee: Mannesmann Tally Corporation, Kent, Wash.

[21] Appl. No.: 693,581

[22] Filed: Jan. 22, 1985

[51] Int. Cl.[4] ..... B41J 3/12

[52] U.S. Cl. ..... 400/124; 101/93.05

[58] Field of Search ..... 400/124; 101/93.05; 335/304, 281

[56] References Cited

U.S. PATENT DOCUMENTS

| | | | |
|---|---|---|---|
| 3,592,311 | 7/1971 | Chow et al. | 101/93 |
| 3,659,238 | 4/1972 | Griffing | 335/229 |
| 3,672,482 | 6/1972 | Brumbaugh et al. | 197/1 |
| 4,037,704 | 7/1977 | Golobay et al. | 197/1 |
| 4,225,250 | 9/1980 | Wagner et al. | 400/124 |
| 4,233,894 | 11/1980 | Barrus et al. | 101/93.04 |
| 4,273,039 | 6/1981 | Luo et al. | 101/93.02 |
| 4,389,127 | 6/1983 | Bellinger | 400/124 |
| 4,401,392 | 8/1983 | Blomquist | 400/124 |

FOREIGN PATENT DOCUMENTS

| | | | |
|---|---|---|---|
| 27365 | 3/1981 | Japan | 400/124 |
| 83461 | 5/1982 | Japan | 400/124 |

*Primary Examiner*—Paul T. Sewell

*Attorney, Agent, or Firm*—Christensen, O'Connor, Johnson & Kindness

[57] ABSTRACT

A print head for a dot matrix serial printer, including a high energy permanent magnet (13) surrounded by a plurality of coil/post combinations (15, 17) each aligned with a print hammer (23), is disclosed. The high energy permanent magnet (13) is centrally mounted on a ferromagnetic base plate (11) having a plurality of outwardly extending arms (41). A coil/post combination (15,17) is mounted on each arm (41). The coil/post combinations (15,17) are surrounded by an apertured spacer ring (19) formed on a nonmagnetic material. The hammers (23) are formed by the inwardly extending arms of a print hammer disc (21) mounted on the spacer ring (19) such that a hammer (23) is aligned with each coil/post combination (15,17). The tips of the hammers overly a stepped pole (25) mounted on the outer end of the high energy permanent magnet (13). When the coils (15) are deenergized, the magnetic flux produced by the permanent magnet (13) stresses the hammers (23) by pulling them against the tips of their related posts (17). While pulled toward the stepped pole, the hammer tips remain spaced therefrom. The hammers and the stepped pole (25) are sized, configured and positioned such that the tips of the hammers lie in the step region (109) of the stepped pole (25). As a result, magnetic flux flowing between the stepped pole (25) and the hammer tips is split between two main paths, one lying generally orthogonal to the plane of the hammers and the other lying generally coplanar with the plane of the hammers. Energization of any coil (15) by a pulse of appropriate polarity and magnitude cancels the magnetic force pulling the related hammer (23) against the related post (17), releasing the hammer (23). The stored energy created by stressing the hammer (23) causes the hammer (23) to press an associated dot printing wire (27) against a ribbon resulting in the printing of a dot on a print receiving medium. Termination of the coil energization pulse results in the hammer (23) being reattracted to its related post (17). Splitting the magnetic flux at the stepped pole (25) reduces the magnetic force at the stepped pole, allowing the hammers (23) to be more readily released.

25 Claims, 3 Drawing Figures

PERMANENT MAGNET, STORED ENERGY, PRINT HEAD

TECHNICAL AREA

This invention relates to printing mechanisms and, more particularly, printing mechanisms for dot matrix printers.

BACKGROUND OF THE INVENTION

In general, dot matrix printers can be separated into two types of printers—line printers and serial printers. Line printers include print heads that create horizontal lines of dots substantially simultaneously as paper moves vertically through the printer. A series of dot lines create a line of characters (or a design). Serial printers include a print head that is horizontally moved back and forth across the paper, either continuously or in steps. The print head of dot matrix serial printers includes a vertical column of dot printing elements. As each column position of a character position is reached, the required number of dot printing elements are actuated. A series of dot columns creates a character (or part of a design). While developed for use in print heads for dot matrix serial printers, certain aspects of the hereinafter described invention may also be useful in dot matrix line printers.

The printing elements of the print heads of both serial and line dot matrix printers are electromagnetically actuated. The electromagnetic actuation mechanisms include hammers that press the dot printing element against the print receiving medium. In some print heads, the hammers are held in a retracted position by the magnetic force created by a permanent magnet. When retracted, the hammers are stressed and, thus, store energy. When a coil mounted on a post located in the magnetic flux path of a hammer is suitably energized, the magnetic field produced by the coil counteracts the magnetic field produced by the permanent magnet resulting in the release of the hammer. The energy stored in the stressed hammer causes the printing of a dot. One example of a print head for a dot matrix serial printer that functions in this manner is described in U.S. Pat. No. 4,225,250 entitled "Segmented-Ring Magnet Print Head" by Richard E. Wagner et al. Other examples are described in U.S. Pat. Nos. 3,592,311, 3,659,238, 3,672,482, and 4,037,704.

While the small size and lack of complexity of the print head described in U.S. Pat. No. 4,225,250 made it substantially advanced over print heads of the type described in the other patents referred to in the preceding paragraph, it remains subject to improvement. For example, its heat dissipation ability is less than desirable. Furter, it is heavier than desirable. Both of these factors restrict the speed of operation of dot matrix serial printers employing such print heads. More specifically, the print head described in U.S. Pat. No. 4,225,250 includes a ring magnet mounted on a base plate. The base plate also supports a plurality of coil/post combinations mounted inside of the ring magnet. A print hammer disc including a plurality of inwardly projecting hammer arms is mounted on the permanent magnet such that a hammer arm overlies each of the coil/post combinations. The print hammer disc is covered by a face plate. As a result, the heat generating elements of the print head—the coils—are entirely enclosed. Because the coils are entirely enclosed, the heat generated by the coils is not readily dissipated. Since heat generation is directly related to the coil energy dissipated when hammers are released, heat generation is related to the speed of hammer actuation. Since excessive heat can damage and/or destroy the release coils, printer speed is related to heat generation and, thus, heat dissipation. Since the heat dissipation ability of print heads of the type described in U.S. Pat. No. 4,225,250 is limited, print speed is likewise limited. Further, the ring magnet used in such print heads is relatively large since it surrounds the coil/post combinations. Not only is the ring magnet large and, thus, heavy, the remaining ferromagnetic elements that make up the magnetic circuit of the print head—the base plate and the face plate—are large and, therefore, heavy. As will be understood by those familiar with mechanisms for moving print heads, heavier print heads require more movement energy than do lighter print heads in order to achieve the same speed of operation. In addition to increased operating expense, higher energy requirements necessitate greater cooling in order to avoid breakdowns caused by overheating.

The invention is directed to providing a print head that avoids these disadvantages. More specifically, the invention is directed to providing a print head for a dot matrix serial printer that is lightweight and dissipates the heat generated when the hammers of the print head are actuated.

SUMMARY OF THE INVENTION

In accordance with this invention a print head ideally suited for use in dot matrix serial printers is provided. The print head includes a high energy (e.g., high mgo) permanent magnet surrounded by a plurality of coil/-post combinations each aligned with a print hammer. The high energy permanent magnet is centrally mounted on a ferromagnetic base plate that has a plurality of outwardly extending arms. A coil/post combination is mounted on each arm. The coil/post combinations are surrounded by an apertured spacer ring formed of a nonmagnetic material. The hammers are formed by the inwardly extending arms of a print hammer disc mounted on the spacer ring such that the hammers are aligned with the coil/post combinations. In the absence of electrical current flow in the coils, the magnetic force created by the high energy permanent magnet stresses the hammers by pulling them away from a normal planar position. When a suitable electric pulse is applied to a coil, the magnetic force created by the high energy permanent magnet is counteracted resulting in the related hammer being released. Release of a hammer moves a dot printing element. The dot printing elements creates a dot by, for example, pressing a ribbon against the print receiving medium, e.g., a sheet of paper.

In accordance with further aspects of this invention, a stepped pole is mounted on the outer end of the high energy permanent magnet, in alignment with the tips of the hammers. When the hammers are stressed by the magnetic force produced by the high energy permanent magnet, the tips of the hammers lie in the step of the stepped pole resulting in a splitting of the flux flowing between the tips of the hammers and the stepped pole. Part of the flux flows across air gaps lying in the plane of the print hammer disc and the other flows across air gaps lying orthogonal to the plane of the print hammer disc.

In accordance with further aspects of this invention, preferably, the base plate is mounted on a nonmagnetic support plate. Further, preferably, the dot imprinting elements are wires that extend orthogonally outwardly from the tip region of the hammers. Also, preferably, the wires pass through a front guide that aligns the outer tips of the wires in a column.

As will be readily appreciated from the foregoing description, the invention overcomes the disadvantages of prior art ring magnet print heads of the type described in U.S. Pat. No. 4,225,250 referenced more fully above. More specifically, the apertured spacer ring provides an air path to the coils. Thus, the heat generated by coil actuation is more readily dissipated. If natural airflow is inadequate, increased heat dissipation can be provided by forced airflow through the apertures in the apertured spacer ring. Further, because the magnet that creates the hammer retraction force is located inside of the coil/post combinations, rather than surrounding the coil/post combinations, the size and, thus, the weight of the magnet is reduced. Likewise, because the base plate that supports the coil/post combinations and the ring magnet only needs to extend between a central magnet and the coil/post combinations, rather than to an outer ring magnet, the size and, thus, the weight of the base plate is reduced. Since weight is reduced, print head movement energy can be reduced or, print head speed increased for the same amount of energy as required in the case of print heads of the type described in U.S. Pat. No. 4,225,250. Further, the flux splitting that occurs at the stepped pole reduces the force between the tips of the hammers and the stepped pole to a value less than the force between the hammers and the posts. This force reduction allows the hammers to be more readily released. Hence, the invention provides a print head that has several advantages over print heads of the type described in U.S. Pat. No. 4,225,250.

BRIEF DESCRIPTION OF THE DRAWINGS

The foregoing objects and many of the attendant advantages of this invention will become more readily appreciated as the same becomes better understood by reference to the following detailed description taken in conjunction with the accompanying drawings wherein.

DESCRIPTION OF THE PREFERRED EMBODIMENT

Figure 1:
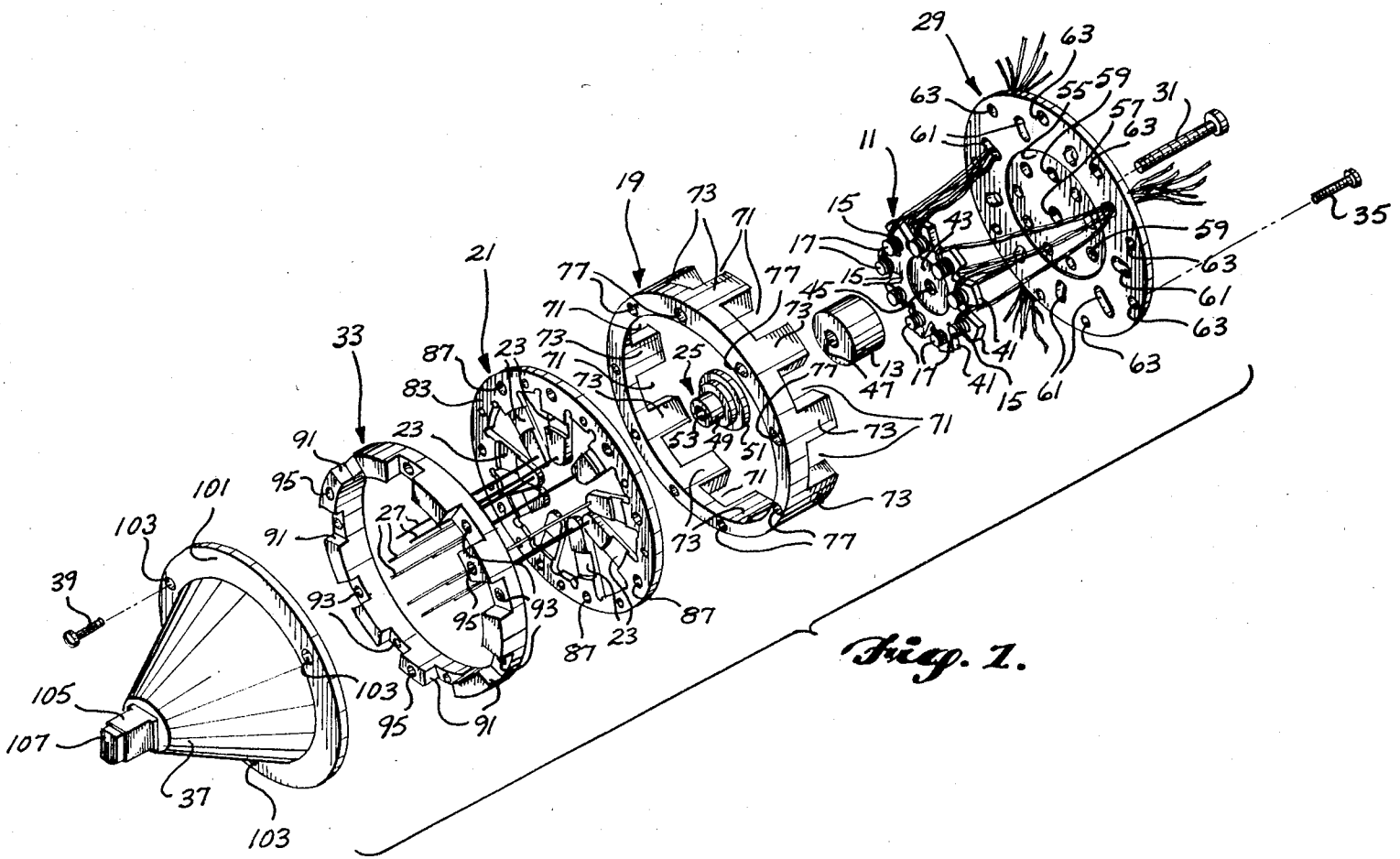
FIG. 1 is an exploded, pictorial view of a permanent magnet, stored energy, print head formed in accordance with the invention.

The major elements of the preferred embodiment of a permanent magnet, stored energy, print head formed in accordance with the invention illustrated in FIG. 1 are: a base plate 11; a high energy (e.g., a high megagaussoersted or mgo) permanent magnet 13; a plurality of coils 15 mounted on posts 17; an apertured spacer ring 19; a print hammer disc 21 having a plurality of inwardly extending arms each of which forms a hammer 23; a stepped disc 25; and, a plurality of print wires 27. Also illustrated in FIG. 1 is a support plate 29; a magnet mounting bolt 31; a clamp ring 33; a plurality of clamp ring cap screws 35; a front guide 37; and, a plurality of front guide cap screws 39.

The base plate 11 is formed of a generally flat sheet of ferromagnetic material, such as a ferromagnetic steel. The base plate 11 includes a plurality of outwardly extending arms 41. The number of arms is equal to the number of dot printing elements, e.g., print wires 27. Since the illustrated embodiment of the invention includes nine print wires 27, the base plate 11 includes nine arms. Preferably the angle between arm centerlines is identical, i.e., 40° in the illustrated embodiment. Mounted on one face of the base plate 11, near the outer end of each of the arms is one of the posts 17. The posts are also formed of a ferromagnetic material. Preferably the posts are riveted into the base plate arms 41. Alternatively, the posts may be threaded into the base plate arms. Wrapped around each of the posts 17 is one of the coils 15. Located in the center of the same face of the base plate 11 as the coils 15 and posts 17 is a circular, magnet locating depression 43. Positioned in the center of the circular depression 43 is a hole 45.

Figure 2:
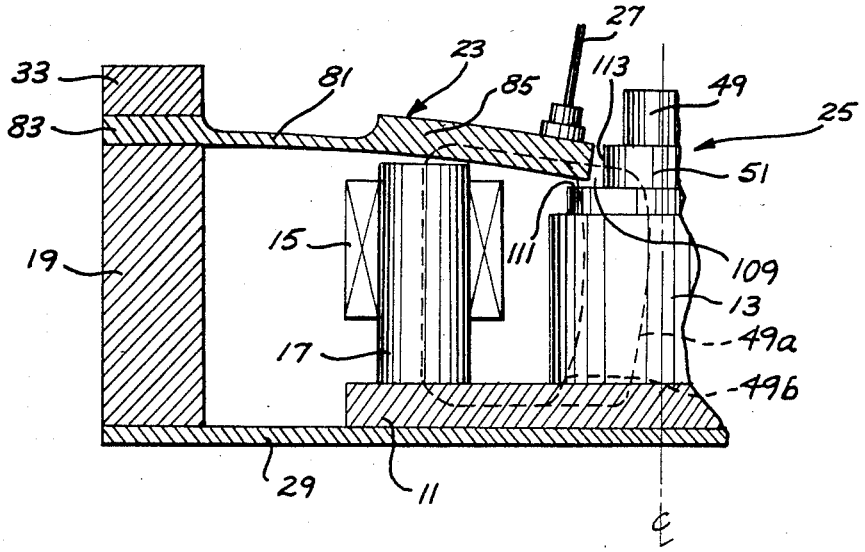
FIG. 2 is a radial cross-sectional view of the print head illustrated in FIG. 1 taken through one of the hammer assemblies.

The high energy permanent magnet 13 is cylindrical and has a diameter substantially equal to the diameter of the depression 43 in the base plate 11. The high energy permanent magnet 13 includes a center hole 47 that is positioned so as to be alignable with the hole 45 positioned in the center of the circular, magnet locating depression 43 in the base plate 11 when the high energy permanent magnet 13 is mounted in the depression 43. (If assembly tooling is used to construct an embodiment of the invention, the magnet locating depression may be dispensed with if unneeded.) The high energy permanent magnet 13 is axially polarized, i.e., the flux lines lie parallel to axis of the hole 45, as illustrated by the magnetic flux lines **49*a* and 49*b* (FIG. 2**). While the high energy permanent magnet may be a rare earth magnet, preferably, it is a boron/neodymium/iron permanent magnet having an mgo value in the 30–35 range, or above.

The stepped pole 25 is, a unitary structure formed of a ferromagnetic material that includes a cylindrical collar 49 and a stepped flange 51. The diameter of the stepped flange is larger than the diameter of the cylindrical collar 49. Located in the cylindrical center of the stepped pole 25 is a threaded hole 53.

The support plate 29 is a relatively thin, circular disc formed of a suitable nonmagnetic material such aluminum. Located in the center of one face of the support plate 29 is a base plate locating depression 55. The diameter of the base plate locating depression 55 is substantially the same as the diameter of the circle defined by the outer ends of the arms 41 of the base plate 11. As with the magnet locating depression 43 in the base plate 11, the base plate locating depression 55 may be deleted as unnecessary if assembly tooling is used to create embodiments of the invention.

Located in the center of the base plate locating depression 55 of the support plate 29 is a hole 57. Located around the periphery of the base plate locating depression 55 are a plurality of holes 59. The number of holes is equal in number to the number of arms 41 of the base plate 11, i.e., nine in the preferred embodiment of the invention illustrated in FIG. 1. The holes are sized and positioned so as to be alignable with the posts 17 mounted on the arms 41 of the base plate 11 when the base plate 11 is positioned in the depression 55 formed in the support plate 29 as hereinafter described. If, as noted above, the posts 17 are threaded into threaded holes in the base plate arms 41 and the threaded holes extend through the base plate arms, the holes 59 in the support plate 29 provide access to the base plate end of the posts 17 so that the posts can be longitudinally adjusted. Preferably, after the posts are adjusted, they are locked in place by the application of a suitable thread locking material, such as an epoxy. Alternatively, if the posts 17 are riveted to the base plate 11, the holes provide clearance for the heads of the rivets.

Located in the portion of the support plate 29 surrounding the depression 55 are a plurality of radial slots 61. The number of radial slots 61 is equal to the number of coils and posts 15 and 17. The connecting wires for each coil pass through one of the slots 59, as shown in FIG. 1. Finally, located around the periphery of the support plate 29 are a plurality of attachment holes 63. The attachment holes are equally spaced and equal in number to the number of coils 15 and posts 17.

As previously described, the depression 55 in the support plate 29 is sized to receive the base plate 11. When the base plate 11 is positioned in the depression 55, the hole 45 is the center of the base plate 11 is aligned with the hole 57 in the center of the depression 55 in the support plate 29. As also previously described, the depression 43 in the base plate 11 is sized to receive one end of the high energy permanent magnet 13 and when the magnet 13 is positioned in the depression 43, the hole 47 in the magnet 13 is aligned with the hole 45 in the center of the base plate 11. Finally, when the stepped pole 25 is positioned against the end of the high energy permanent magnet 13 remote from the end position in the depression 43 in the base plate 11, the threaded hole 53 in the stepped pole 25 is aligned with the hole in the magnet. After the support plate 29, the base plate 11, the high energy magnet 13 and the stepped pole 25 are positioned in the manner just described, the magnet mounting bolt 31 is passed through the aligned center holes in the support plate 29, the base plate 11 and the high energy permanent magnet 13, and threded into the threaded hole 53 in the stepped pole 25.

The apertured spacer ring 19 is formed of a suitable nonmagnetic material, such as aluminum. While generally cylindrical, the apertured spacer ring includes a plurality of apertures 72 defined by legs 73 that extend outwardly from a continuous region located at one end of the spacer ring 19. The legs are equally spaced and equal in number to the number of coils 15 and posts 17. Aligned with each of the legs 73 is a hole 77 whose axis lies parallel to the center axis of the apertured spaced ring. The holes 77 are positioned so as to be alignable with the peripheral holes 63 in the support plate 29 when the apertured spacer ring 19 is positioned such that the tips of legs 73 impinge on the support plate and surround the base plate 11, high energy permanent magnet 13, the coils 15, the posts 17 and the stepped pole 25, as shown in FIG. 1.

Figure 3:
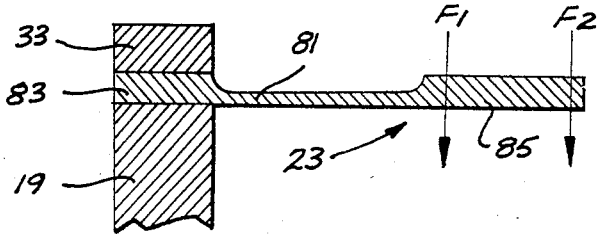
FIG. 3 is a cross-sectional view of a hammer illustrating the magnetic attraction forces applied to the hammer.

The print hammer disc 21 is formed from a flat disc of ferromagnetic material having suitable resiliency. The diameter of the print hammer disc is the same as the diameter of the apertured spacer ring and the print hammer disc is positioned on the side of the spacer ring facing away from the support plate 29. As previously described, the print hammer disc 21 includes a plurality of inwardly projecting arms each of which forms a hammer 23. The number of hammers is equal to the number of coils 15 and posts 17 and the hammers are spaced from each other by equal amounts. As best illustrated in FIGS. 2 and 3, the region 81 of each of the hammers 23 immediately inwardly from an outer ring 83 that joins the hammers is thinner than either the heads 85 of the hammers or the outer ring. The thinner region is created by removing material from the hammers at the side facing away from the coils 15 and posts 17. Alternatively, material could be removed from both sides of the hammers to create the thinner regions. The hammer material may be removed by chemical etching, for example. Formed in the outer ring 83 are a plurality of holes 87, one aligned with each of the hammers. The holes 87 are sized and positioned so as to be alignable with the perihperal holes in the apertured spacer ring 19.

Aligned with a head 85 of each of the hammers 23 is one of the wires 27. More specifically, the wires 27 extend orthogonally outwardly from the hammers on the side thereof remote from the side facing the coils 15 and posts 17.

The clamp ring 33 is cylindrical and formed of a suitable nonmagnetic material, such as aluminum. The outer diameter of the clamp ring 33 is the same as the diameter of the print hammer disc 21. The clamp ring 33 is positioned on the side of the print hammer disc facing away from the apertured spacer ring 19. The clamp ring 33 includes a plurality of depressions 91 extending inwardly from the edge of the clamp ring 33 facing away from the print hammer disc 21. The depressions 91 are equally spaced and equal in number to the number of hammers 23. Located at the bottom of each depression is a threaded hole 93 positioned so as to be alignable with the holes 87 located in the outer ring 83 of the print hammer disc 21. Finally, located in selected ones of the regions of the clamp ring 33 lying between the depressions 91 are threaded holes 95. While the clamp ring illustrated in the drawings has depressions, it is to be understood that the depressions can be eliminated if desired.

The support plate 29, apertured spacer ring 19, print hammer disc 21, and clamp ring 33 are assembled by first positioning the apertured spacer ring 19 atop the support plate 29 such that the holes 77 located in the legs of the apertured spacer ring 19 are aligned with the threaded attachment holes 63 located in the periphery of the support plate 29. Thereafter, the print hammer disc 21 is positioned on the outer face of the apertured spacer ring 19 so that the holes 87 located in the outer ring 83 are aligned with the holes 77 in the apertured spacer ring 19. Next, the clamp ring 33 is positioned against the outer face of the print hammer disc 21 such that the threaded holes 93 in the bottom of the depressions 91 in the clamp ring 33 are aligned with the holes in the print hammer disc 21. Thereafter, the cap screws 35 are passed through the holes in the support plate 29, the apertured spacer ring 19, the print hammer disc 21, and threaded into the threaded holes 63 lying in the depressions in the clamp ring 33.

The front guide 37 is conically shaped and includes a flange 101 extending outwardly from the base of the cone. The outer diameter of the flange 101 is substantially the same as the outer diameter of the clamp ring 33. Located in the flange 101 are a plurality of holes 103 equal in number (three in the illustrated embodiment of the invention) and positioned so as to be alignable with the threaded holes 95 located between the clamp ring depressions 91. Cap screws 39 are passed through the holes 103 in the flange of the front guide 37 and threaded into the threaded holes 95 in the clamp ring 33. The narrow end of the front guide 37 is truncated and includes an outwardly extending nose 105 that houses a jewelled wire guide 107. As will be readily understood by those familiar with print heads used in dot matrix serial printers, the jewelled guide 107 receives the print wires 27 and maintains them aligned in a column. The column lies along a vertical axis when the print head is mounted in a dot matrix serial printer.

As illustrated in FIG. 2, when the elements of the print head illustrated in FIG. 1 are assembled in the manner previously described, each of the hammers 23 overlies a post 17. More specifically, as previously noted, each hammer 23 includes a head 85 that is thicker than a thin region 81 lying between the head 85 and the ring 83 from which the hammers 23 inwardly extend. The length of the head 85 is such that the outer area of the head overlies the tip of the related post 17. The inner end or tip of the head 85 overlies the step region 109 defined by the stepped flange 51 of the stepped pole 25. The step region 109 is defined by a step 111 and a riser 113. The step 109 lies in a plane lying parallel to the outer face of the high energy permanent magnet 13 and the riser 113 defines a cylinder that lies orthogonal to the plane of the step 111.

Prior to being assembled, the outer ring 83 and the hammers 23 that form the print hammer disc 21 are planar. After being assembled, the hammers 23 are pulled from their initial planar position to a stressed position by the attraction force created by the magnetic flux produced by the high energy permanent magnet 13. More specifically, as illustrated in FIG. 2, the attraction force pulls the hammer heads 85 toward their associated posts 17 and the stepped pole 25. The length of the posts 17, the high energy permanent magnet 13 and the stepped pole 25 is such that the heads 85 of the hammers 23 impinge on the tip of its associated post 17 but not on the stepped pole 25. Rather than impinge on the stepped pole 25, the tips of the hammer heads 85 lie in the stepped region 109, spaced from the stepped pole 25 by an air gap. In essence, two air gaps exist, one between the bottom or facing sides of the hammer heads 85 and the step 111 of the stepped pole 25 and the other between the tips of the hammer heads 85 and the riser 113 of the stepped pole 25. As a result, as shown in FIG. 2, the flux flow between the tips of the hammer heads 85 and the stepped pole 25 splits into two paths. One path crosses the gap between the facing side of the hammer heads 85 and the step 111 of the stepped pole 25, and the other crosses the gap between the tips of the hammer heads 85 and the riser 113 of the stepped pole 25. The advantage of this split flow arrangement is discussed next.

As illustrated in FIG. 3, there are two attractive forces that pull the hammers 23 from their planar position into the stressed position shown in FIG. 2. One attractive force ($F_1$) is created by the magnetic flux passing between the tip of the poles 17 and the hammer heads 85. The other attractive force ($F_2$) is created by the magnet flux passing between the step 111 of the stepped pole 25 and the facing side of the hammer heads 85. Since the magnitude of the flux flow between the posts 17 and the hammer heads 85 and between the hammer heads and the stepped pole 25 is the same, if it were not for the flux splitting that occurs at the stepped pole 51, $F_1$ and $F_2$ would be equal. The flux splitting changes this result. More specifically, because the flux is split at the stepped pole, $F_2$ is lower than $F_1$. The reduced $F_2$ magnetic force allows the hammer 23 to be released more readily, i.e., less current flow through the coils 15 is required to release the hammers 23. Since less current is required, less heat is generated when the coils 15 are energized to release their respective hammers 23.

The invention provides a print head that has a number of advantages over previously developed print heads for dot matrix serial printers, particularly print heads of the type described in U.S. Pat. No. 4,225,250, referenced above. The positioning of the permanent magnet inside of the coil/post combinations, rather than outside the coil/post combinations, and surrounding the coil/post combinations with an apertured spacer ring creates a print head having the ability to dissipate the heat generated when the coils are energized to release the print hammers. If normal airflow through the apertures in the apertured spacer ring is inadequate, heat dissipation can be readily increased by using a fan to increase the flow of air through the apertures in the apertured spacer ring. The use of a small permanent magnet and a small base plate produces a lightweight print head, particularly when the elements that house the overall hammer actuating mechanism are formed of lightweight nonmagnetic materials, such as aluminum. Finally, as just noted, flux splitting at one of the hammer head poles provides a print head having more easily released hammers.

While a preferred embodiment of the invention has been illustrated and described, it will be appreciated that various changes can be made therein without departing from the spirit and scope of the invention. For example, while the preferred materials for forming the support plate, apertured spacer ring and clamp ring is aluminum, obviously other materials can be utilized. If desired, nonmagnetic materials, such as suitably strong plastics, can be utilized to form these parts. Further, while the front guide and clamp ring are illustrated as separate elements, they can be combined, if desired. Also they can take on other shapes. And, the wire guide can be other than a jeweled guide (i.e., other materials can be used) if desired. Various other structural modifications also can be made, including but not limited to, increasing (or reducing) the number of base plate arms and, correspondingly, the numbers of coil/post combinations, hammers and print wires. Hence, the invention can be practiced otherwise than as specifically described herein.

The embodiments of the invention in which an exclusive property or privilege is claimed are defined as follows:

1. A print head for a serial dot matrix printer comprising:

a base plate formed of a ferromagnetic matrial and including a center region and a plurality of outwardly extending arms;

a high energy permanent magnet mounted in the center of said base plate such that the magnetic lines of flux produced by said magnet lie generally orthogonal to said base plate;

a plurality of electromagnetic elements, one of said plurality of electromagnetic elements being mounted on the outer end of each of said arms of said base plate on the same face of said base plate as said high energy permanent magnet so as to surround said high energy permanent magnet;

a hammer support surrounding said plurlity of electromagnetic elements and said high energy permanent magnet, said hammer support including a support plate and an apertured spacer ring, said base plate being mounted in a central location on said support plate and said apertured spacer ring mounted on said support plate so as to surround said base plate, said plurality of electromagnetic elements and said high energy permanent magnet;

a plurality of hammers, equal in number to the number of electromagnetic elements, mounted on said hammer support, said plurality of hammers being planar and formed of a resilient, magnetically permeable material, said plurality of hammers being mounted such that a hammer is aligned with each electromagnetic element and said high energy permanent magnet and forms a magnetic flux path between said high energy permanent magnet and its associated electromagnetic element, said hammers being positioned such that each hammer is drawn from an unstressed planar state into stressed cocked state by said high energy permanent magnet pulling hammers toward their associated electromagnetic elements, said pulling action occurring in the absence of the application of electric power to said electromagnetic elements; and, a plurality of dot printing elements equal in number to said number of hammers, one of said dot printing elements positioned so as to be moved into a print position by each of said hammers when electric power is applied to the electromagnetic element associated with the hammer.

2. A print head for a serial dot matrix printer as claimed in claim 1, wherein said plurality of hammers comprise a print hammer disk formed of a resilient, magnetically permeable material, said print hammer disk including an outer ring and a plurality of arms extending inwardly from said outer ring, each of said arms forming one of said plurality of hammers, said outer ring being mounted on said apertured spacer ring.

3. A print head for a serial dot matrix printer as claimed in claim 2, wherein the portion of each of said hammers overlying its associated electromagnetic element and said high energy permanent magnet is thicker than the portion of said hammers extending between their associated electromagnetic elements and said ring.

4. A print head for a serial dot matrix printer as claimed in claim 3, including a stepped pole mounted on the outer end of said high energy permanent magnet in alignment with the outer ends of said print hammers.

5. A print head for a serial dot matrix printer as claimed in claim 4, wherein said stepped pole includes a stepped region in which the tips of said hammers lie when said hammers are drawn from an unstressed planar state into a stressed cocked state by said high energy permanent magnet pulling said hammers toward their associated electromagnetic elements.

6. A print head for a serial dot matrix printer as claimed in claim 5, wherein said tips of said hammers lying in said stepped region of said stepped pole are spaced from the step and riser of said stepped pole such that two air gaps are formed therebetween, one lying transverse to the plane of said hammers and the other lying in the plane of said hammers when said hammers are drawn from an unstressed planar state into a stressed cocked state by said high energy permanent magnet pulling said hammers toward their associated electromagnetic elements.

7. In a printer wherein flat, generally planar hammers having a fixed end and a movable end are drawn from an unstressed position into a stressed cocked position by a pulling magnetic force that is counteracted by another magnetic force to release the hammers, the improvement comprising: a stepped pole aligned with the fixed end of said hammers, said stepped pole including a step region defined by a step lying parallel to said hammers and a riser lying orthogonal to said hammers, the tips of said hammers lying in said step region when said hammers are in said stressed cocked position resulting in the magnetic flux between said hammers and said stepped pole being split, part of said flux flowing between said hammers and said step and part of said flux flowing between said hammers and said riser.

8. The improvement claimed in claim 7 wherein an air gap exists between the tips of said hammers and both said riser and said step of said stepped pole.

9. A print head for a serial dot matrix printer comprising:

a base plate formed of a ferromagnetic material;

a high energy permanent magnet mounted on said base plate such that the magnetic lines of flux produced by said magnet lie generally orthogonal to said base plate;

a plurality of electromagnetic elements mounted on the same face of said base plate as said high energy permanent magnet so as to surround said high energy permanent magnet;

a hammer support surrounding said plurality of electromagnetic elements and said high energy permanent magnet, said hammer support including a support plate and an apertured spacer ring, said base plate being mounted in a central location on said support plate and said apertured spacer ring mounted on said support plate so as to surround said base plate, said plurality of electromagnetic elements and said high energy permanent magnet;

a plurality of hammers, equal in number to the number of electromagnetic elements, mounted on said hammer support, said plurality of hammers being planar and formed of a resilient, magnetically permeable material, said plurality of hammers being mounted such that a hammer is aligned with each electromagnetic element and said high energy permanent magnet and forms a magnetic flux path between said high energy permanent magnet and its associated electromagnetic element, said hammers being positioned such that each hammer is drawn from an unstressed planar state into a stressed cocked state by said high energy permanent magnet pulling hammers toward their associated electromagnetic elements, said pulling action occurring in the absence of the application of electric power to said electromagnetic elements; and, a plurality of dot printing elements equal in number to said number of hammers, one of said dot printing elements positioned so as to be moved into a print position by each of said hammers when electric power is applied to the electromagnetic element associated with the hammer.

10. A print head for a serial dot matrix printer as claimed in claim 9, wherein said plurality of hammers comprise a print hammer disk formed of a resilient, magnetically permeable material, said print hammer disk including an outer ring and a plurality of arms extending inwardly from said outer ring, each of said arms forming one of said plurality of hammers, said outer ring being mounted on said apertured spacer ring.

11. A print head for a serial dot matrix printer as claimed in claim 10, wherein the portion of each of said hammers overlying its associated electromagnetic element and said high energy permanent magnet is thicker than the portion of said hammers extending between their associated electromagnetic elements and said ring.

12. A print head for a serial dot matrix printer as claimed in claim 11, including a stepped pole mounted on the outer end of said high energy permanent magnet in alignment with the outer ends of said print hammers.

13. A print head for a serial dot matrix printer as claimed in claim 12, wherein said stepped pole includes a stepped region in which the tips of said hammers lie when said hammers are drawn from an unstressed planar state into a stressed cocked state by said high energy permanent magnet pulling said hammers toward their associated electromagnetic elements.

14. A print head for a serial dot matrix printer as claimed in claim 13, wherein said tips of said hammers lying in said stepped region of said stepped pole are spaced from the step and riser of said stepped pole such that two air gaps are formed therebetween, one lying transverse to the plane of said hammers and the other lying in the plane of said hammers when said hammers are drawn from an unstressed planar state into a stressed cocked state by said high energy permanent magnet pulling said hammers toward their associated electromagnetic elements.

15. A print head for a serial dot matrix printer comprising:

a base plate formed of a ferromagnetic material;

a high energy permanent magnet mounted on said base plate such that the magnetic lines of flux produced by said magnet lie generally orthogonal to said base plate;

a plurality of electromagnetic elements mounted on the same face of said base plate as said high energy permanent magnet so as to surround said high energy permanent magnet;

a hammer support surrounding said plurality of electromagnetic elements and said high energy permanent magnet;

a plurality of hammers, equal in number to the number of electromagnetic elements, mounted on said hammer support, said plurality of hammers being planar and formed of a resilient, magnetically permeable material, said plurality of hammers being mounted such that a hammer is aligned with each electromagnetic element and said high energy permanent magnet and forms a magnetic flux path between said high energy permanent magnet and its associated electromagnetic element, said hammers being positioned such that each hammer is drawn from an unstressed planar state into a stressed cocked state by said high energy permanent magnet pulling hammers toward their associated electromagnetic elements, said pulling action occurring in the absence of the application of electric power to said electromagnetic elements;

a stepped pole mounted on the outer end of said high energy permanent magnet in alignment with the outer ends of said print hammers, said stepped pole including a stepped region in which the tips of said hammers lie when said hammers are drawn from an unstressed planar state into a stressed cocked state by said high energy permanent magnet pulling said hammers toward their associated electromagnetic elements; and, a plurality of dot printing elements equal in number to said number of hammers, one of said dot printing elements positioned so as to be moved into a print position by each of said hammers when electric power is applied to the electromagnetic element associated with the hammer.

16. A print head for a serial dot matrix printer as claimed in claim 1, wherein said tips of said hammers lying in said stepped region of said stepped pole are spaced from the step and riser of said stepped pole such that two air gaps are formed therebetween, one lying transverse to the plane of said hammers and the other lying in the plane of said hammers when said hammers are drawn from an unstressed planar state into a stressed cocked state by said high energy permanent magnet pulling said hammers toward their associated electromagnetic elements.

17. A print head for a serial dot matrix printer as claimed in claim 15, wherein:

said base plate includes a center region and a plurality of outwardly extending arms;

and high energy permanent magnet is mounted in the center of said base plate; and one of said plurality of electromagnetic elements is mounted on the outer end of each of said arms of said base plate.

18. A print head for a serial dot matrix printer as claimed in claim 17, wherein said hammer support means includes an apertured spacer ring mounted so as to surround said plurality of electromagnetic elements and said high energy permanent magnet.

19. A print head as claimed in claim 18, wherein:

said hammer support also includes a support plate;

said base plate is mounted in a central location on said support plate; and said apertured spacer ring is mounted on said support plate so as to surround said base plate.

20. A print head for a serial dot matrix printer as claimed in claim 19, wherein said plurality of hammers comprise a print hammer disk formed of a resilient, magnetically permeable material, said print hammer disk including an outer ring and a plurality of arms extending inwardly from said outer ring, each of said arms forming one of said plurality of hammers, said outer ring being mounted on said apertured spacer ring.

21. A print head for a serial dot matrix printer as claimed in claim 20, wherein the portion of each of said hammers overlying its associated electromagnetic element and said high energy permanent magnet is thicker than the portion of said hammers extending between their associated electromagnetic elements and said ring.

22. A print head for a serial dot matrix printer as claimed in claim 1, wherein said hammer support means includes an apertured spacer ring mounted so as to surround said plurality of electromagnetic elements and said high energy permanent magnet.

23. A print head as claimed in claim 22, wherein:

said hammer support also includes a support plate;

said base plate is mounted in a central location on said support plate; and said apertured spacer ring is mounted on said support plate so as to surround said base plate.

24. A print head for a serial dot matrix printer as claimed in claim 23, wherein said plurality of hammers comprise a print hammer disk formed of a resilient, magnetically permeable material, said print hammer disk including an outer ring and a plurality of arms extending inwardly from said outer ring, each of said arms forming one of said plurality of hammers, said outer ring being mounted on said apertured spacer ring.

25. A print head for a serial dot matrix printer as claimed in claim 24, wherein the portion of each of said hammers overlying its associated electromagnetic element and said high energy permanent magnet is thicker than the portion of said hammers extending between their associated electromagnetic elements and said ring.

* * * * *

UNITED STATES PATENT AND TRADEMARK OFFICE

CERTIFICATE OF CORRECTION

PATENT NO. : 4,591,280

DATED : May 27, 1986

INVENTOR(S) : Edward D. Bringhurst

It is certified that error appears in the above-identified patent and that said Letters Patent is hereby corrected as shown below:

Column 8, line 49, "matrial" should be --material--
(Claim 1, line 3)
Column 8, line 62, "plurlity" should be --plurality-
(Claim 1, line 16)
Column 9, line 14, Insert --a-- before "stressed"
(Claim 1, line 36)
Column 11, line 68, "1" should be --15--
(Claim 16, line 2)
Column 12, line 44, "1" should be --15--
(Claim 22, line 2)

Signed and Sealed this

*Ninth* Day of *September 1986*

[SEAL]

*Attest:*

DONALD J. QUIGG

*Attesting Officer* *Commissioner of Patents and Trademarks*